US010209027B2

(12) United States Patent
Chu et al.

(10) Patent No.: US 10,209,027 B2
(45) Date of Patent: Feb. 19, 2019

(54) RETENTION STRUCTURE OF CROSSBOW

(71) Applicant: MAN KUNG Enterprise Co., Ltd., Taichung (TW)

(72) Inventors: Fu-Hui Chu, Taichung (TW); Ching-Chi Hung, Taichung (TW)

(73) Assignee: Man Kung Enterprises Co., Ltd., Taichung (TW)

( * ) Notice: Subject to any disclaimer, the term of this patent is extended or adjusted under 35 U.S.C. 154(b) by 0 days.

(21) Appl. No.: 15/891,430

(22) Filed: Feb. 8, 2018

(65) Prior Publication Data

US 2019/0025003 A1 Jan. 24, 2019

(30) Foreign Application Priority Data

Sep. 17, 2017 (TW) ..... 106210594 U

(51) Int. Cl.
*F41B 5/12* (2006.01)
*F41B 5/14* (2006.01)

(52) U.S. Cl.
CPC ..... *F41B 5/12* (2013.01); *F41B 5/1426* (2013.01)

(58) Field of Classification Search
CPC ..... F41B 5/12; F41B 5/1426; F41B 5/143
USPC ..... 124/25
See application file for complete search history.

(56) References Cited

U.S. PATENT DOCUMENTS 5,085,200 A * 2/1992 Horton-Corcoran ..... F41B 5/1469 124/25
5,598,829 A * 2/1997 Bednar ..... F41A 17/28 124/25
5,884,614 A * 3/1999 Darlington ..... F41B 5/12 124/25
7,455,059 B2 * 11/2008 Shaffer ..... F41B 5/123 124/25
7,814,894 B2 * 10/2010 Giroux ..... F41B 5/1469 124/25
8,061,339 B2 * 11/2011 Shaffer ..... F41B 5/123 124/25
8,091,540 B2 * 1/2012 Matasic ..... F41B 5/12 124/25
8,656,899 B2 * 2/2014 Bednar ..... F41B 5/12 124/25
8,662,061 B1 * 3/2014 Darlington ..... F41B 5/12 124/25
8,857,420 B2 * 10/2014 Grace ..... F41B 5/123 124/25

(Continued)

*Primary Examiner* — Alexander Niconovich

(74) *Attorney, Agent, or Firm* — Alan D. Kamrath; Kamrath IP Lawfirm, P.A.

(57) ABSTRACT

A retention structure of a crossbow contains a fixer including a seat, a rolling element, a resilient element, and a shock absorber. The seat has an affix sheet, a fitting tube, at least one threaded aperture, an accommodation aperture, and an engagement portion. A diameter of the engagement portion is less than that of the accommodation aperture. The seat contacts with the connection mount. At least one screwing element screws with the at least one threaded aperture via the at least one locking orifice. The rolling element is housed in the accommodation aperture of the seat and is limited by the engagement portion. The resilient element is housed in the accommodation aperture and abuts against the connection mount and the rolling element. The shock absorber has a through hole and fits on the fitting tube of the seat by using the through hole.

8 Claims, 5 Drawing Sheets

(56) References Cited

U.S. PATENT DOCUMENTS

| | | | | |
|---|---|---|---|---|
| 8,899,218 | B2 * | 12/2014 | Kempf | F41B 5/1469<br>124/35.1 |
| 8,931,465 | B1 * | 1/2015 | Choma | F41B 5/12<br>124/25 |
| 9,255,755 | B1 * | 2/2016 | Barnett | F41B 5/12 |
| 9,417,029 | B1 * | 8/2016 | Chang | F41B 5/143 |
| 9,435,605 | B2 * | 9/2016 | McPherson | F41A 17/46 |
| 9,557,134 | B1 * | 1/2017 | Yehle | F41B 5/12 |
| 9,879,936 | B2 * | 1/2018 | Yehle | F41B 5/066 |
| 2013/0098343 | A1 * | 4/2013 | Grace | F41B 5/123<br>124/25 |
| 2015/0159975 | A1 * | 6/2015 | Darlington | F41B 5/12<br>124/25 |
| 2017/0131059 | A1 * | 5/2017 | McPherson | F41B 5/123 |

* cited by examiner

RETENTION STRUCTURE OF CROSSBOW

BACKGROUND OF THE INVENTION

Field of the Invention

The present invention relates to a crossbow and, more particularly, to a retention structure of the crossbow which enhances stability after shooting an arrow.

Description of the Prior Art

A conventional crossbow contains a body and a limb. The body has a crossbow butt formed on a rear end thereof, a trigger arranged on a front end of the crossbow butt, a connection mount connected on the trigger, and a sight telescope fixed on the connection mount. The limb is in an arc shape and is mounted adjacent to a front end of the body. The limb intersects with the body so that the body and the limb are formed in a cross shape. In operation, a bowstring is pulled backward to hook on the trigger, an arrow is placed on the body to correspond to the bowstring, and a target is aimed by using the sight telescope. Thereafter, the trigger is pressed so that the bowstring removes from the trigger, and so that the arrow is pushed to shoot outwardly.

To stabilize the crossbow after shooting the arrow, a fixer is secured on a bottom of the connection mount, such that the fixer abuts against the arrow. The fixer includes a guide sleeve with an outer threaded section screwing with a screwing orifice of the connection mount. Thus, the guide sleeve cannot be moved based on using requirements. Furthermore, the screwing orifice is drilled in the connection mount, so that the connection mount deforms or breaks easily.

The present invention has arisen to mitigate and/or obviate the afore-described disadvantages.

SUMMARY OF THE INVENTION

The primary objective of the present invention is to provide a retention structure of a crossbow in which a fixer contacts with a bottom of a connection mount and is adjustably moved based on using requirements.

Another objective of the present invention is to provide a retention structure of a crossbow in which the connection mount is supported by the fixer to avoid deformation and damage.

To obtain above-mentioned objectives, the crossbow contains: a body, a limb, a trigger, a connection mount, and a fixer. The body includes a crossbow butt formed on a rear end thereof, and the body includes a guide groove extending rearward from a top of a front end thereof. The limb is in an arc shape and is mounted adjacent to the front end of the body, and the limb intersects with the body so that the body and the limb are formed in a cross shape. The limb includes a bowstring fixed on two ends thereof, and the trigger is connected with a front end of the crossbow butt of the body. The connection mount is secured on a top of the trigger, and the connection mount includes at least one locking orifice defined adjacent to a front end of the connection mount. The fixer includes: a seat, a rolling element, a resilient element, and a shock absorber.

The seat has an affix sheet, a fitting tube extending downward from the affix sheet, at least one threaded aperture formed on the affix sheet, an accommodation aperture defined on a top of the affix sheet and vertically passing through the fitting tube, and an engagement portion arranged below the accommodation aperture. A diameter of the engagement portion is less than that of the accommodation aperture. The seat contacts with a bottom of the connection mount. At least one screwing element screws with the at least one threaded aperture of the affix sheet via the at least one locking orifice of the connection mount.

The rolling element is housed in the accommodation aperture of the seat and is limited by the engagement portion below the accommodation aperture, such that a part of the rolling element extends out of a bottom of the accommodation aperture.

The resilient element is housed in the accommodation aperture of the seat, and two ends of the resilient element abut against the bottom of the connection mount and the rolling element.

The shock absorber has a through hole defined on a center thereof and fits on the fitting tube of the seat by using the through hole.

DETAILED DESCRIPTION OF THE PREFERRED EMBODIMENTS

The present invention will be clearer from the following description when viewed together with the accompanying drawings, which show, for purpose of illustration only, preferred embodiments in accordance with the present invention.

Figure 1:
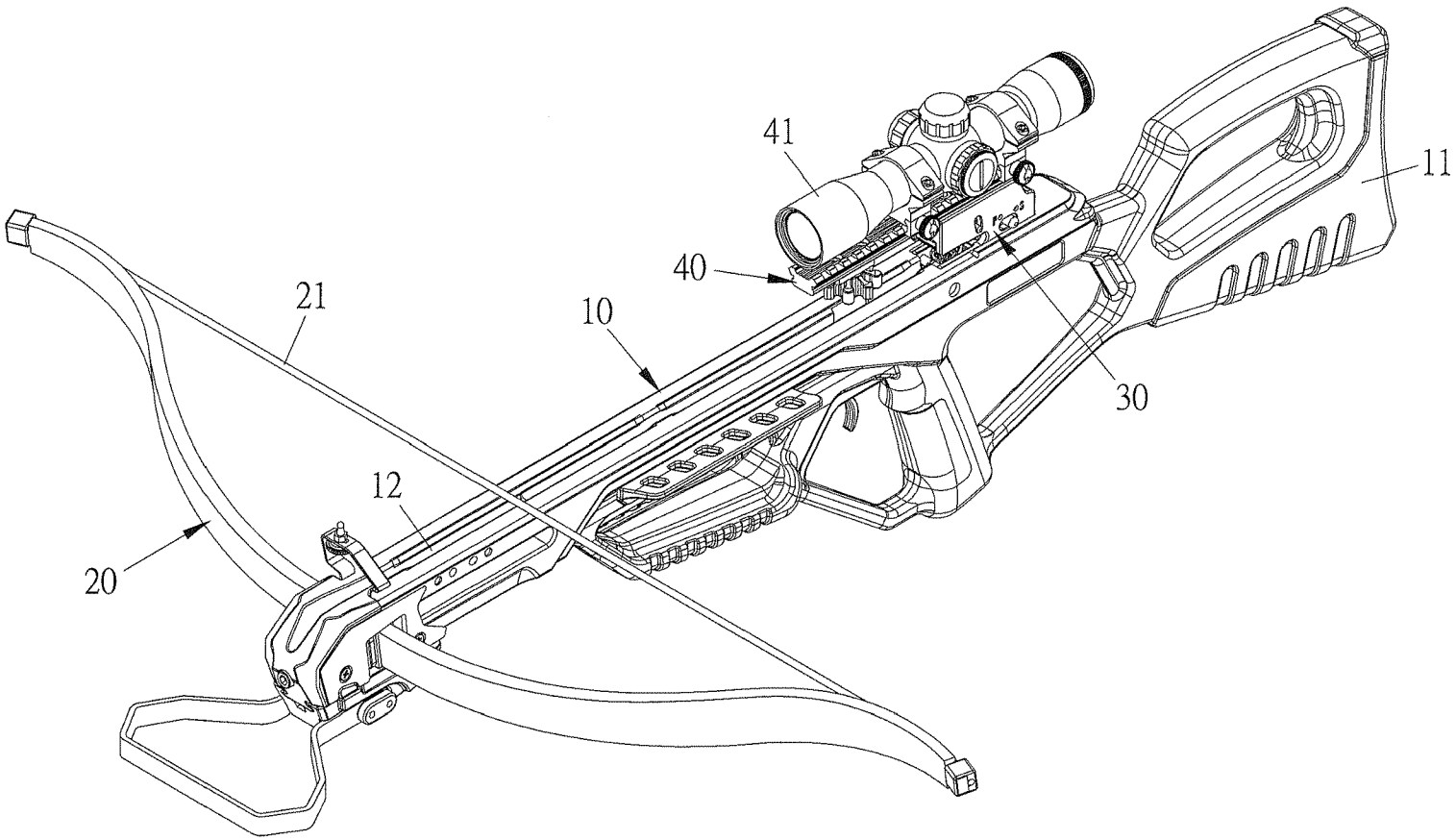
FIG. 1 is a perspective view showing the assembly of a crossbow according to a preferred embodiment of the present invention.
Figure 2:
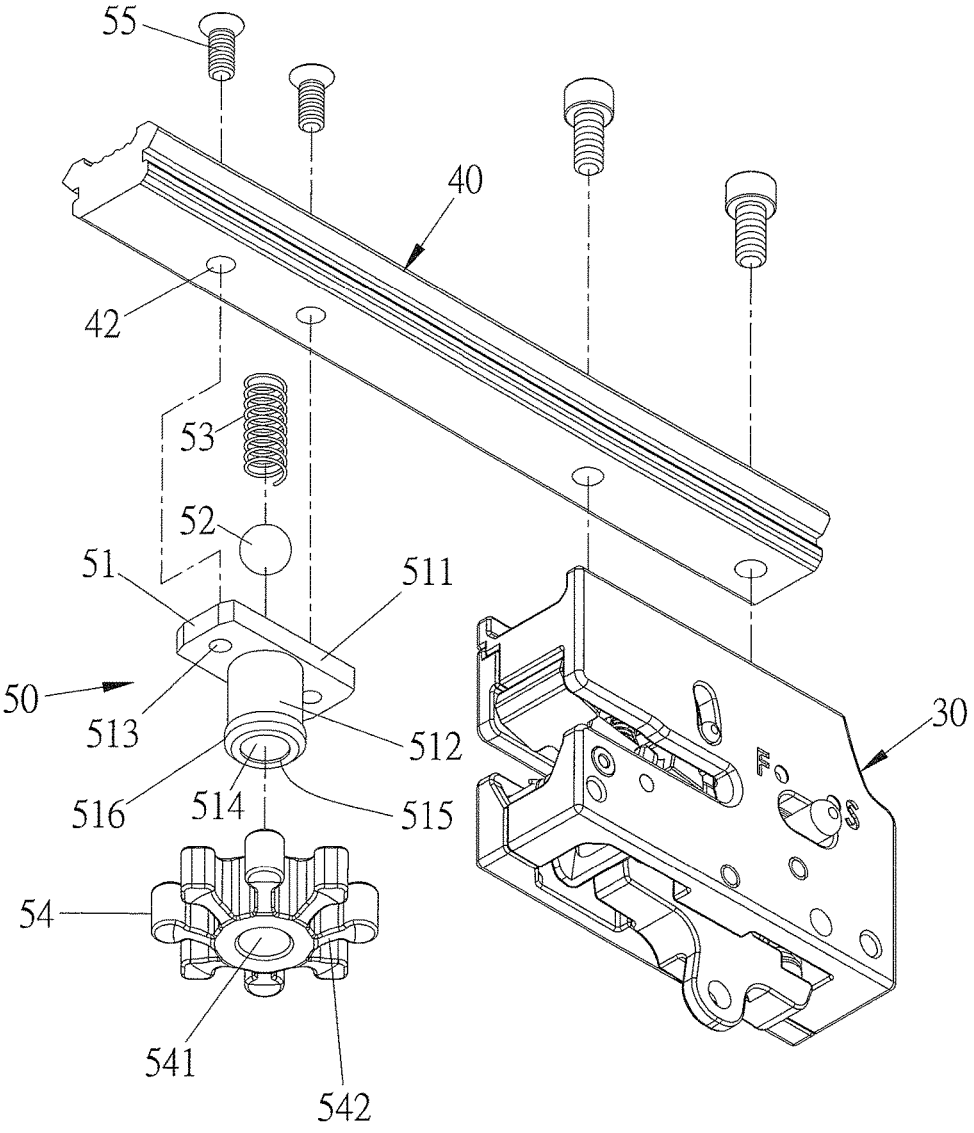
FIG. 2 is a perspective view showing the exploded components of a part of the crossbow according to the preferred embodiment of the present invention.
Figure 3:
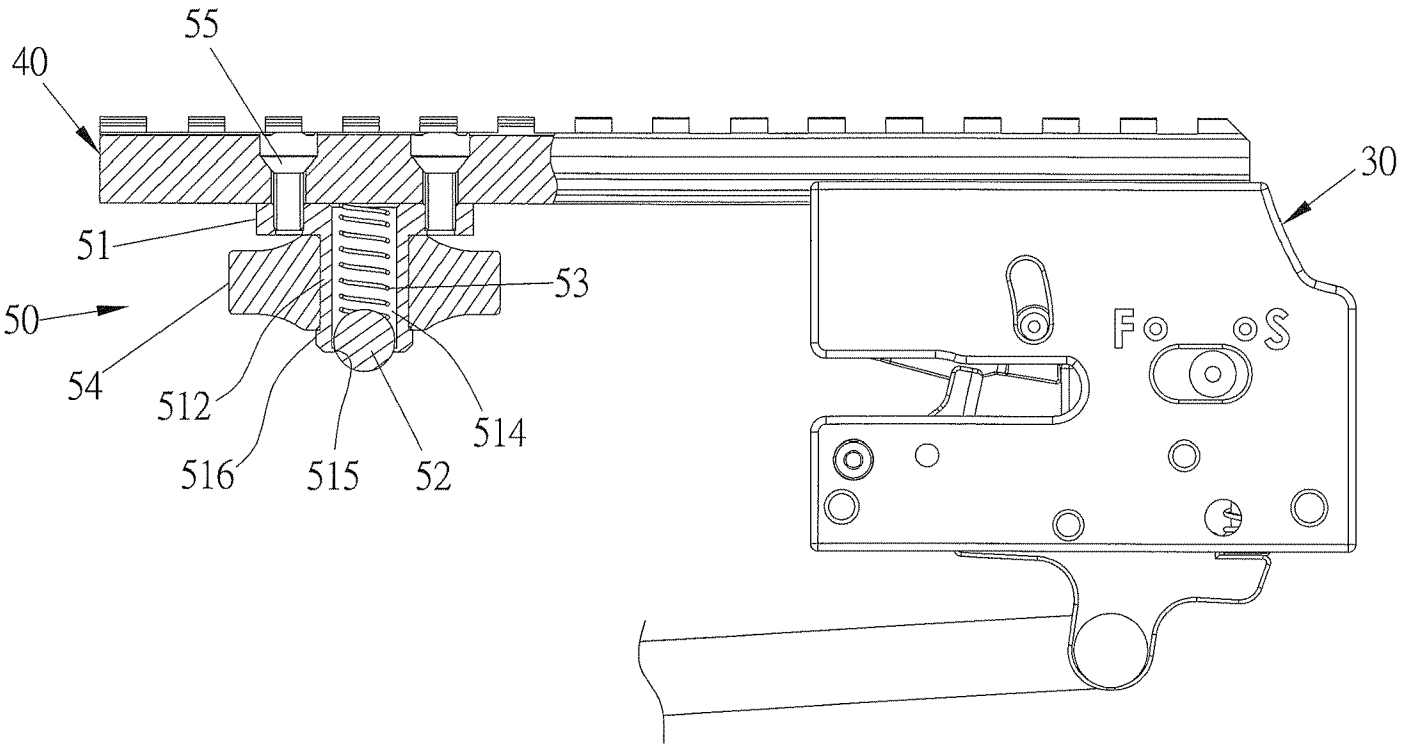
FIG. 3 is a cross sectional view showing the assembly of a part of the crossbow according to the preferred embodiment of the present invention.

With reference to FIGS. 1-3, in a retention structure of a crossbow in accordance with a preferred embodiment of the present invention, the crossbow comprises: a body 10, a limb 20, a trigger 30, a connection mount 40, and a fixer 50.

The body 10 includes a crossbow butt 11 formed on a rear end thereof, and the body 10 includes a guide groove 12 extending rearward from a top of a front end thereof. The limb 20 is in an arc shape and is mounted adjacent to the front end of the body 10. The limb 20 intersects with the body 10 so that the body 10 and the limb 20 are formed in a cross shape, and the limb 20 includes a bowstring 21 fixed on two ends thereof. The trigger 30 is connected with a front end of the crossbow butt 11 of the body 10, and the connection mount 40 is secured on a top of the trigger 30 and is configured to hold a sight telescope 41. The connection mount 40 includes at least one locking orifice 42 defined adjacent to a front end of the connection mount 40 (In this embodiment, the connection mount 40 includes two locking orifices 42 defined adjacent to the front end thereof). The fixer 50 includes a seat 51, a rolling element 52, a resilient element 53, and a shock absorber 54.

The seat 51 has a rectangular affix sheet 511, a fitting tube 512 extending downward from the rectangular affix sheet 511, at least one threaded aperture 513 formed on the rectangular affix sheet 511 (in this embodiment, the seat 51 has two threaded apertures 513), an accommodation aperture 514 defined on a top of the rectangular affix sheet 511 and vertically passing through the fitting tube 512, and an engagement portion 515 arranged below the accommodation aperture 514. A diameter of the engagement portion 515 is less than that of the accommodation aperture 514. The seat 51 further has a shoulder 516 arranged on an outer wall of a lower end of the fitting tube 512, and the seat 51 contacts with a bottom of the connection mount 40 by way of the rectangular affix sheet 511. Two screwing elements 55 screw with the two threaded apertures 513 of the rectangular affix sheet 511 respectively via the two locking orifices 42 of the connection mount 40.

The rolling element 52 is a steel ball housed in the accommodation aperture 514 of the seat 51 and limited by the engagement portion 515 below the accommodation aperture 514, such that a part of the rolling element 52 extends out of a bottom of the accommodation aperture 514.

The resilient element 53 is a spring housed in the accommodation aperture 514 of the seat 51, and two ends of the resilient element 53 abut against the bottom of the connection mount 40 and the rolling element 52.

The shock absorber 54 has a through hole 541 defined on a center thereof and fits on the fitting tube 512 of the seat 51 by using the through hole 541, and the shock absorber 54 is limited by the shoulder 516 of the fitting tube 512. The shock absorber 54 has multiple extending ribs 542 radially extending outward from a peripheral side thereof.

Figure 4:
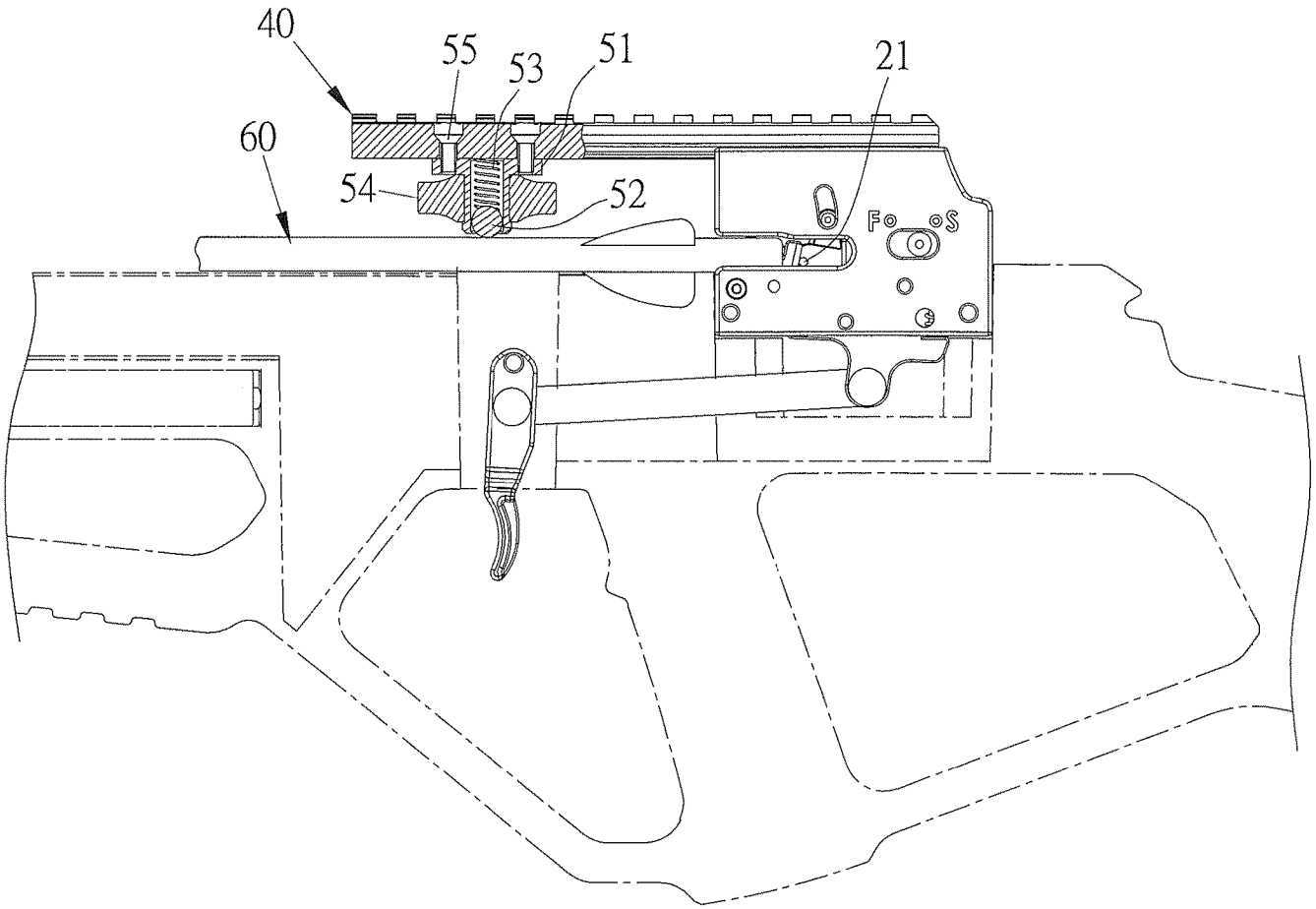
FIG. 4 is another cross sectional view showing the assembly of a part of the crossbow according to the preferred embodiment of the present invention.
Figure 5:
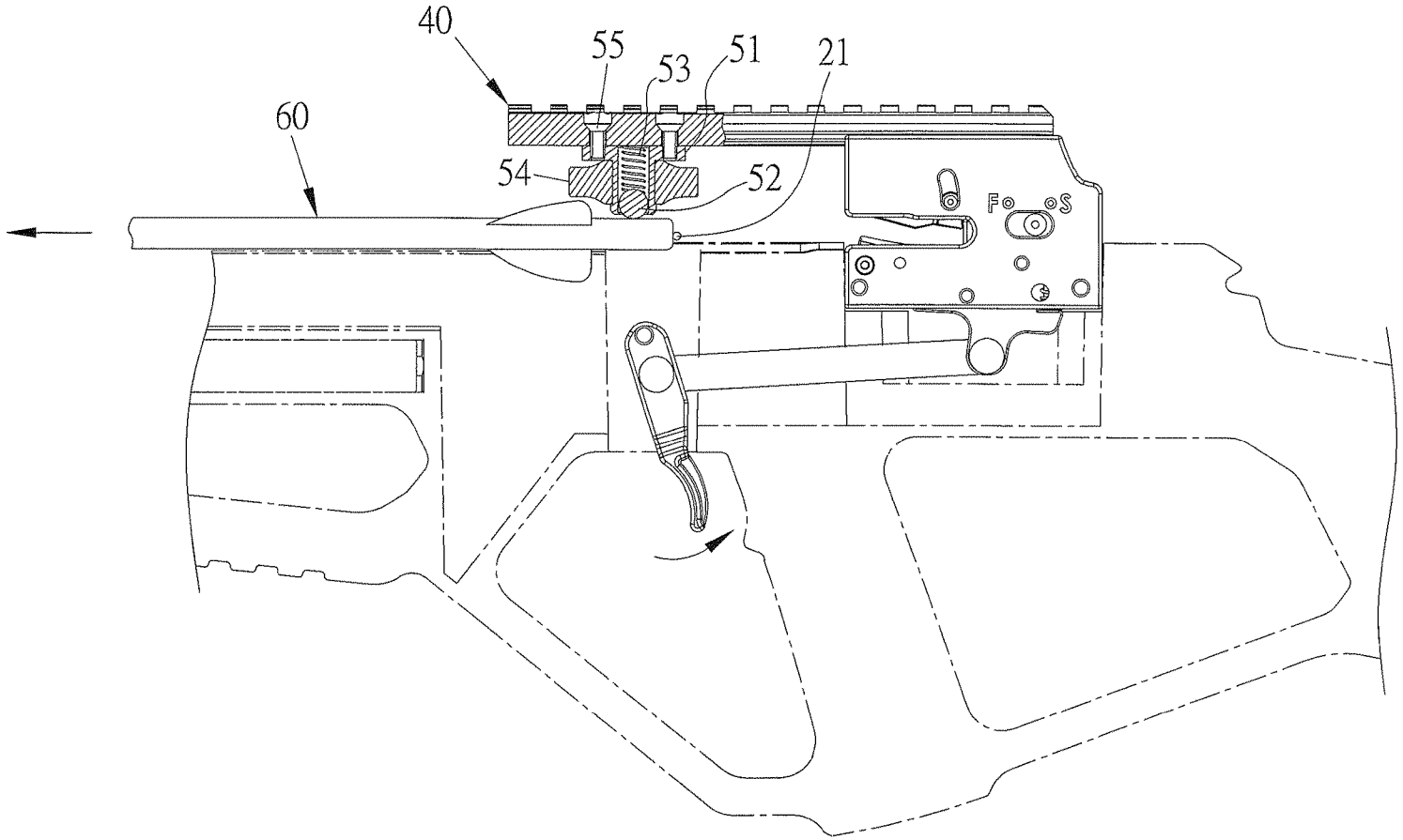
FIG. 5 is a cross sectional view showing the operation of the crossbow according to the preferred embodiment of the present invention.

Referring to FIGS. 4 and 5, in operation, the bowstring 21 is pulled backward to hook on the trigger 30, and an arrow 60 is placed in the guide groove 12 of the body 10 to correspond to the bowstring 21. Hence, the arrow 60 is located on a triggering position. In the meantime, the rolling element 52 of the fixer 50 is biased against the arrow 60 by way of the resilient element 53, to secure the arrow 60. After shooting the arrow 60, the shock absorber 54 absorbs shooting vibration to stabilize the body 10.

Thereby, the retention structure of the present invention has the following advantages:

The fixer 50 is removed easily, and its related components are replicable quickly. Preferably, the fixer 50 contacts with the bottom of the connection mount 40 and is adjustably moved based on using requirements. In addition, the connection mount 40 is supported by the fixer 50 to avoid damage.

While various embodiments in accordance with the present invention have been shown and described, it is clear to those skilled in the art that further embodiments may be made without departing from the scope of the present invention.

What is claimed is:

1. A retention structure of a crossbow, with the crossbow comprising: a body, a limb, a trigger, a connection mount, and a fixer, wherein the body includes a crossbow butt formed on a rear end thereof, wherein the body includes a guide groove extending rearward from a top of a front end thereof, wherein the limb is in an arc shape and is mounted adjacent to the front end of the body, wherein the limb intersects with the body so that the body and the limb are formed in a cross shape, wherein the limb includes a bowstring fixed on two ends thereof, wherein the trigger is connected with a front end of the crossbow butt of the body, wherein the connection mount is secured on a top of the trigger, wherein the connection mount includes at least one locking orifice defined adjacent to a front end of the connection mount, wherein the fixer includes:

a seat having an affix sheet, a fitting tube extending downward from the affix sheet, at least one threaded aperture formed on the affix sheet spaced from the fitting tube, an accommodation aperture defined on a top of the affix sheet spaced from the at least one threaded aperture and vertically passing through the fitting tube, and an engagement portion arranged below the accommodation aperture, wherein a diameter of the engagement portion is less than that of the accommodation aperture, wherein the seat contacts with a bottom of the connection mount, and wherein at least one screwing element screws with the at least one threaded aperture of the affix sheet via the at least one locking orifice of the connection mount;

a rolling element housed in the accommodation aperture of the seat and limited by the engagement portion below the accommodation aperture, such that a part of the rolling element extends out of a bottom of the accommodation aperture;

a resilient element housed in the accommodation aperture of the seat, wherein two ends of the resilient element abut against the bottom of the connection mount and the rolling element; and a shock absorber having a through hole defined on a center thereof and fitting on the fitting tube of the seat by using the through hole.

2. The retention structure as claimed in claim 1, wherein the rolling element is a steel ball.

3. The retention structure as claimed in claim 1, wherein the resilient element is a spring.

4. The retention structure as claimed in claim 1, wherein the seat contacts with the bottom of the connection mount by the affix sheet extending parallel to and abutting with the bottom of the connection seat.

5. The retention structure as claimed in claim 4, wherein the affix sheet is a bar.

6. The retention structure as claimed in claim 5, wherein the shock absorber includes a top surface and a bottom surface with the through hole extending between and through the top and bottom surfaces, with the top surface abutting with the affix sheet, and with the bottom surface is spaced from and intermediate the rolling element and the top surface.

7. The retention structure as claimed in claim 6, wherein the seat further has a shoulder arranged on an outer wall of a lower end of the fitting tube, and wherein the shock absorber is limited by the shoulder of the fitting tube abutting with the bottom surface.

8. The retention structure as claimed in claim 7, wherein the shock absorber has multiple extending ribs radially extending outward away from the through hole and from a peripheral side thereof.

* * * * *